United States Patent [19]

Smith

[11] 4,152,007

[45] May 1, 1979

[54] SKI BRAKE

[76] Inventor: Jack E. Smith, 6845 Peters Rd., Dayton, Ohio 45414

[21] Appl. No.: 789,792

[22] Filed: Apr. 22, 1977

[51] Int. Cl.[2] ..... A63C 7/10

[52] U.S. Cl. ..... 280/605; 188/6

[58] Field of Search ..... 280/605, 604, 11.37 B, 280/11.37 H, 11.37 G, 611, 11.2, 11.21; 188/8, 5, 6

[56] References Cited

U.S. PATENT DOCUMENTS

| | | | |
|---|---|---|---|
| 1,625,226 | 4/1927 | Simmons | 188/5 |
| 2,358,213 | 9/1944 | Courage | 280/604 |
| 2,856,029 | 10/1958 | Hereil et al. | 188/6 |
| 3,246,907 | 4/1966 | Chisholm | 280/612 |
| 3,528,672 | 9/1970 | Wunder | 280/612 |
| 3,614,119 | 10/1971 | Wilkes | 280/611 |
| 3,724,867 | 4/1973 | Hawthorne | 280/605 |

FOREIGN PATENT DOCUMENTS

| | | | |
|---|---|---|---|
| 708099 | 4/1965 | Canada | 188/8 |
| 570655 | 6/1933 | Fed. Rep. of Germany | 280/605 |
| 1428881 | 12/1968 | Fed. Rep. of Germany | 280/605 |
| 2305830 | 8/1974 | Fed. Rep. of Germany | 280/605 |
| 691328 | 7/1965 | Italy | 280/605 |
| 38771 | 1/1924 | Norway | 280/605 |
| 77813 | 1/1918 | Switzerland | 280/605 |
| 651868 | 4/1951 | United Kingdom | 280/11.2 |

*Primary Examiner*—David M. Mitchell

*Attorney, Agent, or Firm*—Dybvig & Dybvig

[57] ABSTRACT

A ski brake comprises plow means pivotally mounted to the trailing end of each of a pair of skis and hydraulic operator means to move said plow means downwardly and under the trailing ends of the skis to plow snow on which the skis are operating upwardly behind the skis. The hydraulic operator means is assembled to a ski pole carried by the skier, hydraulic forces developed by the operator means being transmitted through a harness attached to the skier's waist.

8 Claims, 5 Drawing Figures

FIG-1
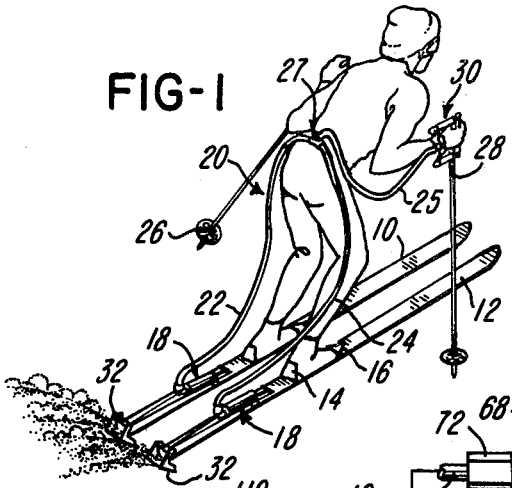
FIG-2
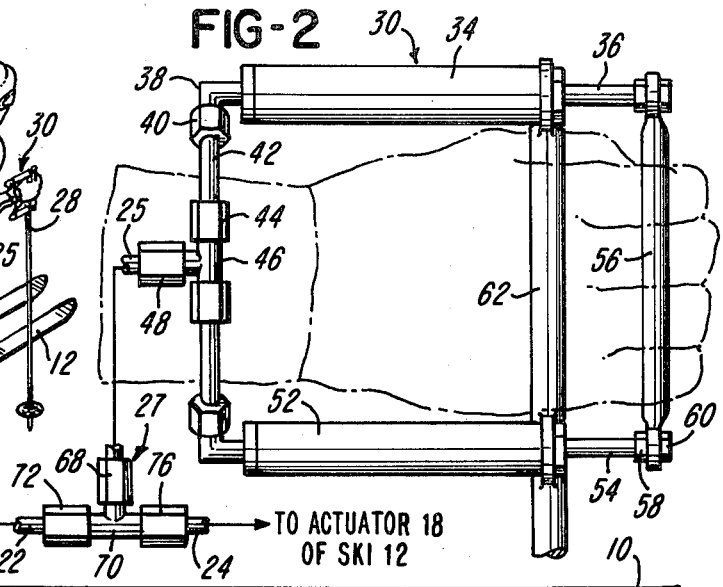
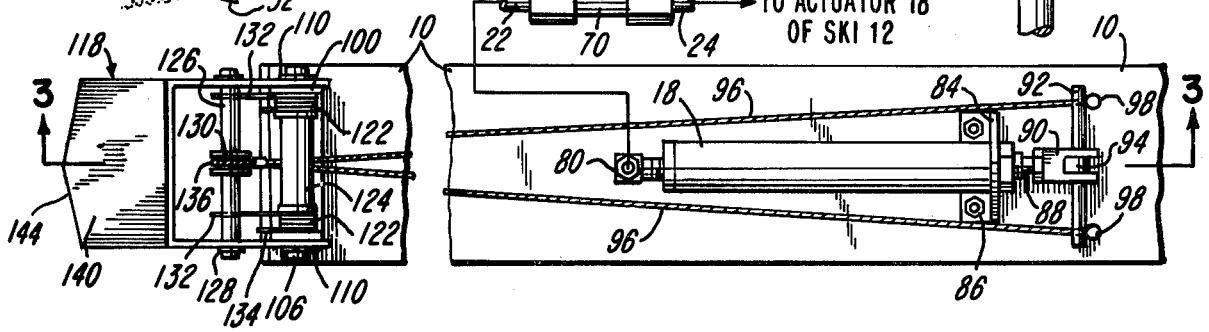
FIG-3
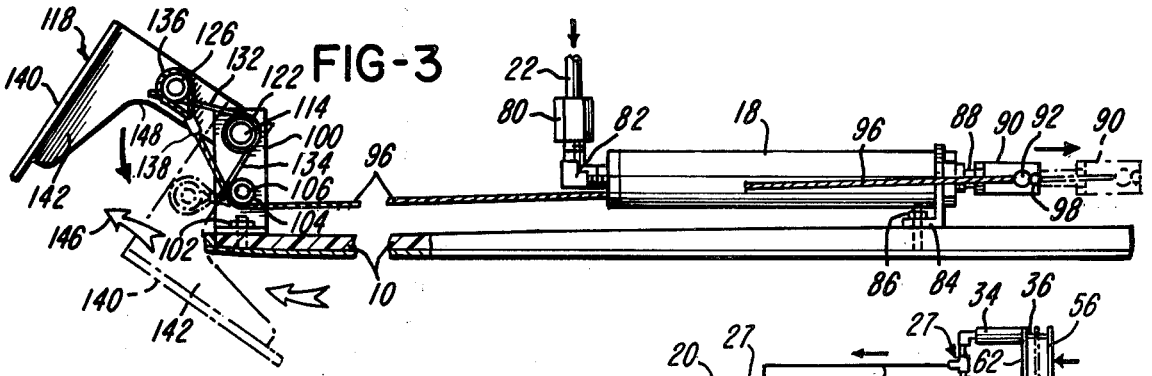
FIG-4
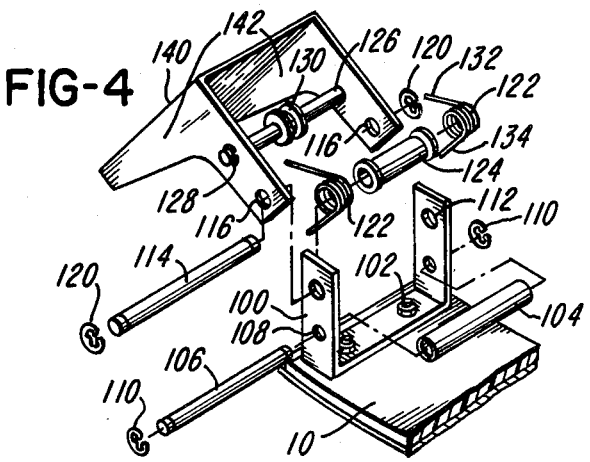
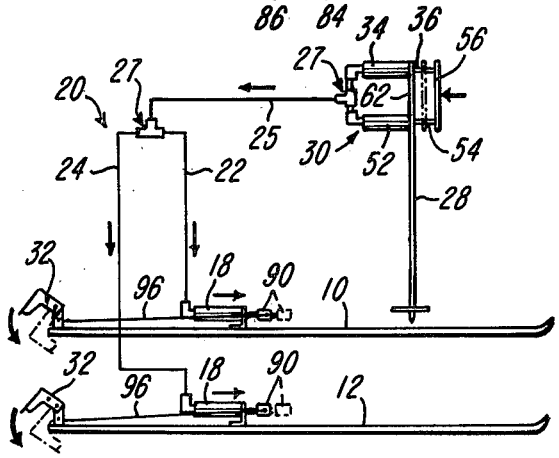
FIG-5

SKI BRAKE

BACKGROUND OF THE INVENTION

1. Field of the Invention

This invention relates to traction or brake means for assisting a skier in the control of his skis and more particularly to brake means in the form of snowplows mounted at the trailing ends of skis and to means subject to the control of the skier for operating said brake means.

2. Prior Art

U.S. Pat. No. 2,358,213 is representative of a large number of patents residing in the prior art which disclose blade devices mounted to skis and movable for downward entry into the snow upon which the skis are operated. Most typically, such devices are employed as brakes during upward climbing motions to retard a rearward slippage of the skis. U.S. Pat. No. 3,724,867 illustrates a skid-retarding device or brake, the operation of which is triggered through the medium of a ski pole carried by the skier. U.S. Pat. No. 3,614,119 is of interest for its disclosure of a means to release a ski binding which is subject to the control of an operating mechanism associated with a ski pole carried by the skier, operating forces being transmitted to the ski binding through a harness attached to the skier's body.

A difficulty with the ski brake devices residing in the prior art is that they lack a uniform gradation such as would enable a skier to gradually increase or decrease the traction forces generated by operation of the brake mechanism. Such devices thus have a usefulness which is generally limited to walking or climbing procedures in which the skier moves the skis from static starting positions. A further limitation to the devices of the prior art results from an inability of such devices to so distribute the load between left and right skis that the traction effort will be shared between the left and right skis.

It is accordingly an object of the present invention to provide a ski traction device which operates in the manner of a snowplow.

Another object of the present invention is to provide an improved operating mechanism for ski traction devices.

Still another object of the present invention is to provide ski traction devices operable in pairs by operating means inherently capable of distributing the traction effort between the members of the pair.

Other objects and advantages will become apparent from the following description and from the drawings.

SUMMARY OF THE INVENTION

In the present invention, each of a pair of skis has a blade or plow member spaced from the trailing end of the ski and associated with operating mechanism capable of rotating the blade member in a direction which plunges the blade member into the snow upon which the ski is traveling and, with sufficient actuation, advances the blade member somewhat under the trailing end of the ski so as to cause snow on which the ski is traveling to be plowed upwardly behind the ski. In contrast to the prior art devices which rely upon the accumulation of snow under the trailing end of the ski for the accomplishment of a braking action, the present device decelerates the forward motion of the skis by doing work in lifting snow upwardly behind the trailing ends of the skis. Spring means normally retract the blades from the snow to allow unimpeded free skiing but may be overcome by a hydraulic mechanism subject to the control of the operator to accomplish a smoothly controlled braking action. The hydraulic mechanism comprises operator means in the form of a hand grip associated with a ski pole, the skier controlling the braking action by a manual pressure exerted on the hand grip. To distribute the work load between the skis, the hydraulic mechanism includes a harness worn by the skier which distributes the application of hydraulic forces to the blades associated with the left and right skis in a manner which inherently causes the decelerative work to be shared.

BRIEF DESCRIPTION OF THE DRAWINGS

FIG. 1 is a perspective illustration of a skier using the brake mechanism of the present invention.

FIG. 2 is an enlarged fragmentary plan view illustrating the manual operator mechanism of the present invention in association with elements attached to a ski which are operated by the operator mechanism.

FIG. 3 is a sectional view taken substantially along the line 3—3 of FIG. 2, illustrating with broken lines an operative position of the present invention.

FIG. 4 is an exploded fragmentary perspective view illustrating a snowplowing means associated with present invention.

FIG. 5 is a diagrammatic illustration of the relationship between operating elements of the present invention.

DESCRIPTION OF THE PREFERRED EMBODIMENT

FIG. 1 illustrates a skier mounted to skis 10 and 12 by means of conventional heel bindings 14 and toe bindings 16.

Spaced behind the heel bindings 14 are hydraulic actuators 18 which are mounted to the skis 10 and 12 in a manner to be described, there being one hydraulic actuator 18 for each of the skis 10 and 12.

The skier is wearing a harness 20 strapped to his waist as by a conventional belt. The harness 20 comprises an assembly of hoses, including a hose 22 extending downwardly from the waist to the actuator 18 located on the left ski, a hose 24 extending downwardly from the waist to the actuator 18 located on the right ski, and a hose 25 extending upwardly from the hose coupling 27 to a hand grip 30 held optionally in the left or right hand of the skier.

The skier may hold a ski pole 26 of conventional construction in his other hand, and a ski pole 28 is attached to the hand grip 30.

Located at the trailing ends of the skis 10 and 12 are brake devices 32 normally biased out of the snow on which the skis are traveling but movable, by a squeeze of the hand grip 30, into the snow on which the skis are traveling so as to plow snow upwardly behind the trailing ends of the skis.

As best seen in FIG. 2, the hand grip 30 comprises a hydraulic actuator 34 having an operating rod 36. Hydraulic fluid displaced from the actuator 34 is conveyed through tubing elements 38 and 42 joined by a junction 40 and then through a junction 44 which connects the tubing elements to a T section 46.

The base of the T section 46 is connected by means of a junction sleeve 48 to the aforementioned hose 25. The tubing elements 42, 44, 46 and 48 may comprise metal or a generally rigid plastic. The hose 25 is preferably of a yieldable plastic material, such as polyethylene, so that the hose 25 will readily bend to follow the arm movements of the skier.

The hand grip 30 includes a second actuator 52 having an operator rod 54 secured to a handlebar 56 by means of nuts 58 and 60 threadedly engaged to the operator rod 54. The handlebar 56 is secured in a similar fashion to the aforementioned operating rod 36.

The operating handle 30 is preferably equipped with a crossbar 62 bridging the two hydraulic actuators 34 and 52 to provide the skier with a balanced structure by means of which a squeezing force can be applied to the crossbar 12 and the handlebar 56 without the operating handle 30 tending to assume awkward positions in the skier's hand. But for the desire that the operating handle 30 be comfortably received in the skier's hand, it is obviously possible that the operating handle 30 could be constructed with only a single hydraulic actuator which is appropriately sized for the tasks to be described.

The pressurized fluid delivered by both of the actuators 34 and 52, serving as master actuators, is comingled in the hose 25 and conveyed through a junction 68 to a T section 70 from which the fluid is given equal paths to the actuators 18 located on the skis and serving as slave actuators. The path to the actuator 18 located on the ski 10 thus proceeds from the T section 70 through a union 72 to the flexible hose 22. Similarly, the fluid has an equal path through a union 76 and the flexible hose 24 to the actuator located on the right ski 12.

FIG. 3 illustrates the actuator 18 located on the left ski 10 where it can be seen that fluid from the hose 22 is conducted to the actuator 18 through a union joint 80 and an elbow joint 82. The actuators 18 are of a conventional, commercially available design, and fluid entering the actuator 18 illustrated in FIG. 3 fills the left end of the actuator, as it appears in FIG. 3, to exert a force against a piston (not shown) residing in the actuator 18. As will be more fully explained, the hydraulic fluid present in the actuators 34 and 52, in the hoses comprising the harness worn by the skier and in the actuators 18, one for each ski, comprise a closed fluid system which has been carefully filled with a hydraulic fluid to the exclusion of air. Thus, when it was said that hydraulic fluid flows from the elbow joint 82 into the actuator 18 of FIG. 3, it is to be understood that such fluid flow necessitated a movement of the cylinder residing in the actuator 18 to the right, as appears in FIG. 3.

The movement of the cylinder residing within the actuator 18 is transmitted for the purpose of accomplishing work by means of an actuator rod 88 which is attached to the cylinder and which advances a clevis member 90 journalling a shaft 92.

The actuator 18 is fixedly mounted to the ski 10 by means of a mounting bracket 84 affixed to the actuator 18 and bolted to the ski 10 by means of a bolt 86. Thus, the described operation of the actuator 18 in response to fluid forced thereto through the elbow joint 82 necessitates that the clevis 90 move axially along the length of the ski 10.

The shaft 92 is preferably centered transversely of the clevis 90 by means of a centering collar 94 disposed within the clevis 90 and brazed or otherwise secured to the shaft 92.

The opposite ends of the shaft 92 are bored to receive the ends of a continuous cable 96, each end being secured against withdrawal from the shaft 92 by means of an enlarged cable terminator 98, the cable terminators being welded or otherwise affixed to the cable 96 in a manner which precludes unraveling of the cable.

Mounted to the rear of the ski 10 for operation by the cable 96 is one of the aforementioned brake devices 32. The device comprises a generally U-shaped bracket 100 secured to the ski 10 at the bight of the bracket by fastener means 102. The bracket 100 supports an idler roll 104 journalled upon a shaft 106 entering aligned apertures 108 disposed in the upright sides of the bracket, the shaft 106 being secured against lateral movement by means of spring clips 110 seated in appropriate grooves (not shown) located near the ends of the shaft 106.

The upstanding sides of the bracket 100 also have aligned apertures 112 journalling a shaft 114. The shaft 114 also passes through aligned apertures 116 located in the side portions of a plow member 118, such side portions straddling the upright sides of the bracket 100.

The shaft 114 is secured against lateral movement by means of suitable spring clips 120 seated in appropriate grooves located near the ends of the shaft, but before such spring clips are assembled to the shaft 114, spring members 122 are placed on the ends of the shaft 114 between the sides of the bracket 100 and separated by an idler sleeve 124. The shaft 114 is thus supported perpendicular to the longitudinal axis of the ski 10 and parallel to the underside of that ski.

The side portions 142 of the plow member 118 are apertured to journal a transverse shaft 126 secured by spring clips 128 seated in suitably located grooves adjacent the ends of the shaft 126. Journalled on the shaft 126 is a pulley 130.

The aforementioned cable 96 is pulled rearwardly at its center under the idler roll 104 and is passed over the pulley 130 so as to form a loop 136 encircling the pulley. The size of the loop 136 is restricted by means of a metal band member 138 tightly compressed about the two sides of the cable which form the loop 136.

The aforementioned springs 122 terminate with end portions 132 and 134, which impart to each of the springs an overall V shape and which are trapped, as best appears in FIG. 3, between the shaft 126 and the idler roll 104. In the absence of a tensive force along the length of the cable 96 generated by one or both of the actuators 18, the springs 122 are of sufficient size and strength to bias the plow member 118 upwardly by a force exerted on the shaft 126 to approximately the position illustrated in solid lines in FIG. 3.

The plow member 118 can be seen to include a trailing blade portion 140 from which the side portions 142 of the plow member are bent outwardly to the general parallel relationship illustrated in FIG. 4. It can be noted that the position of the plow member 118 normally established by the bias of the springs 122 is such as to lift the blade member 140 to a level above the surface of the snow upon which the lower surface of the ski 10 would be sliding. Thus, the bias of the springs 122 is ordinarily sufficient to hold the blade member 140 out of contact with snow and thus, in effect, in a position which will not disturb the normal skiing activities of a skier.

The foregoing remarks have been addressed to the construction of the brake mechanism 32 located at the trailing end of the ski 10, and it should be appreciated that the construction of the brake mechanism 32 located at the trailing end of the ski 12 is the same.

One can assume that the skier has exerted a squeezing force upon the handle 30 with his right hand, thus displacing hydraulic fluid from the actuators 34 and 52 into the actuators 18 located on the left- and right-hand skis 10 and 12. This displacement of hydraulic fluid will cause the clevises 90, one for each ski, to advance to the right, as appears in FIGS. 2 and 3, thus pulling each loop 136 downwardly and to the right, as it appears in FIG. 3. This action will cause the plow members 118, one for each ski, to move downwardly into the snow upon which the skis are sliding. To allow such movement to occur with a progressive resistance offered by the snow upon which the skis are sliding, the trailing blades 140 associated with each of the brake mechanisms 32 are provided with gently pointed, V-shaped edges 144. Thus, the "bite" of each edge 144 into the snow underlying each ski increases progressively as each of the edges 144 proceeds downwardly into the snow.

FIG. 3 illustrates with broken lines the maximum progression of either of the blade portions 140 into the snow upon which the skis slide. This maximum is reached when the actuators 18 have so advanced their clevis members 90 to the right, as appears in FIG. 3, that the sides 142 extending outwardly from the blades 140 have "bottomed" against the trailing ends of the skis. When this "bottoming" occurs, it can be noted that the trailing end of each ski is seated into curved recesses 148 formed in the sides 142 of the plow members 118.

It can be noted that, as the plow members 118 enter the snow upon which the skis are traveling, the initial entry will be the result of an almost vertically downward movement of the trailing blades 140. However, due to the necessity for such trailing blades to orbit about the axis of the shaft 114, the initial vertically downward entry quickly shifts to a plowing entry wherein the blades 140 move under the skis to which they have been assembled toward the broken line position illustrated in FIG. 3.

Important phenomena occur during such movement. The blades 140, because carried by the skis, initially tend to slide the snow forwardly, such snow accumulating between the trailing end of the ski and the blade 140.

Thus, the acceleration of the snow which was initially at rest to the velocity at which the skis are traveling produces a deceleration of the ski velocity. There will, of course, be a continuing accumulation of snow between the trailing ends of the skis and the blades 140 with a continuing deceleration, and very quickly after braking has commenced, snow will commence to slough over the blades 140 so as to be deposited behind the skis.

Assuming, however, that the skier has more tightly squeezed the handle 30 so that the blades 140 have progressed from their initially generally vertical position to a forwardly and downwardly sloping position, such as illustrated by broken lines in FIG. 3, the snow will be plowed upwardly behind the skis without any opportunity for an accumulation of snow in the region between the trailing ends of the skis and the blades 140. Such plowing action occurs whenever the blade 140 projects into the snow or other medium on which the ski is traveling and forms an acute, forwardly diverging angle with the longitudinal axis of the ski.

At substantial skiing velocities, this plowing action hurls snow upwardly behind the skier, sometimes to elevations greater than the height of the skier. As such upward snow movement occurs, the continued digging of the blades 140 into the snow over which the skis are traveling biases the trailing ends of the skis downwardly against the snow, giving the skier a steering capability of a nature quite different than would be available in the absence of this plowing phenomenon. The arrows 146 appearing in FIG. 3 illustrate generally and on a relative basis the snowplowing which occurs when the handle 30 has been actuated to give a maximum braking force.

The foregoing remarks regarding the braking action rendered available by the present invention have discussed the two braking devices 32 as if they act independently. For reasons to be described, however, independent action is not the ordinary case.

As diagrammatically illustrated in FIG. 5, hydraulic fluid displaced from the handle 30 is divided at the T section 46 so as to proceed equally to the left and right actuators 18. For purposes of this discussion, one can assume that one of the skis is traveling on relatively well-packed snow and the other ski overlies a portion of the ski run in which the snow is not so well packed. This would mean that the blade 140 seeking to enter the well-packed snow will encounter a resistance greater than that encountered by the blade 140 associated with the opposite ski. The hydraulic fluid will take the easiest course to the two available actuators 18. Accordingly, the blade 140 seeking to enter the more densely packed snown and thereby encountering the greatest resistance will have a retarded movement as compared to the blade 140 which is entering the less densely packed snow with comparative freedom. Thus, the two blades 140 seek to share the workload.

The foregoing remarks relate to a contrived circumstance in which one ski slides on tightly packed snow and the other ski slides on loosely packed snow. This is not a normal circumstance on a well-prepared ski run. However, the foregoing discussion does illustrate that the two brake devices 32 will tend to contribute equal amounts of work to the braking action, and the likelihood that the skier's balance will be disturbed upon brake application because one ski tends to lag behind the other ski has been minimized.

It was previously noted that the hydraulic fluid is contained in a closed system. Thus, when the skier elects to relax his grip on the handle 30, the springs 122, of which two reside in each of the braking devices 32, will seek to raise the blades 140 to the solid line position illustrated in FIG. 3, and this action of the springs 122 pulls the cylinders residing within the actuators 18 toward the elbows 82 connecting to such actuators with the result that the hydraulic fluid is returned to the operating handle 30. Should skiing be continued during this return, the return of hydraulic fluid to the handle 30 is aided in at least the initial stages of return by the pressure of snow bearing against the blades 140.

While the present invention has been described with reference to snow as the skiing medium upon which the lower surfaces of the skis travel, other skiing media, such as water and snow substitutes, are within the purview of this invention.

Although the preferred embodiment of this invention has been described, it will be understood that various changes may be made within the scope of the appended claims.

Having thus described my invention, I claim:

1. A brake assembly for attachment to a pair of skis of the type adapted for binding to the feet of a skier, each ski having a surface for traveling on a medium for skiing, said brake assembly comprising a pair of blade means, one for each ski, means for mounting said blade means to said skis, each for movement about an axis transverse to the longitudinal axis of the ski to which it is mounted from a first position wherein said blade means is disposed above the surface of the ski to which it is mounted to a second position in which said blade means projects below the level of said surface to plow the medium on which said ski travels, first hydraulic actuator means mounted to one of said skis, second hydraulic actuator means mounted to the other of said skis, means for pressurizing a hydraulic fluid, pressurized fluid delivery means connected to said actuators for dividing said pressurized fluid for delivery equally to both of said actuators, and means for connecting each said actuator to the blade means mounted to the same ski for transmitting forces developed in said actuators to said blade means and for transmitting forces developed by said blade means in reaction to engagement with said medium to said pressurized fluid delivery means so that said blade means seek to share their work loads by reason of the pressurized fluid being delivered equally to said actuators and by reason of the reaction forces of said blade means resulting from engagement with said medium being returned by said fluid to said delivery means.

2. The brake assembly of claim 1 wherein said fluid delivery means comprises first hose means connected to said first actuator means, a second hose means connected to said second actuator means, and means interconnecting said first and second hose means to that said pressurized fluid is given an equal opportunity to influence each of said first and second actuator means.

3. The brake assembly of claim 2 wherein said fluid pressurizing means comprises a third fluid actuator and means for actuation by the hand of a skier for operating said third actuator means.

4. The brake assembly of claim 3 including a third hose means connecting between said third actuator and said interconnecting means.

5. A brake assembly for a ski having a surface for traveling upon a skiing medium comprising, in combination, blade means, means mounted to said ski for movably supporting said blade means, and operating means mounted to said ski and controllable by the skier for moving said blade means while skiing between a first position in which said blade means is disposed above said surface and a second position in which said blade means projects below said surface for engaging said medium, said operating means including a hydraulic slave actuator for attachment to said ski, cable means for operatively connecting said slave actuator with said blade means, said brake assembly including hand grip means having a master hydraulic actuator and flexible tubing means for connecting said master and slave actuators.

6. In skiing apparatus of the type comprising a pair of skis and means for binding the feet of the skier to said skis, said skis adapted for forward movement on a skiing medium in the direction in which the skier's toes point, a pair of blade means, mounting means, one attached to each said ski, for movably mounting said blade means adjacent the rearward ends of said skis, said mounting means supporting said blade means for rotation about an axis transverse to the longitudinal axis of the ski to which the blade means is supported, each blade means including a blade member and means spacing said blade member from the axis about which said blade means is supported for rotation, said blade member sized for entry into the medium upon which said skis will travel, a pair of actuator means, one for each ski, mounted to said skis intermediate the forward and rearward ends thereof, cable means for each said ski operatively connected between the blade means and the actuator means of said each ski, said spacing means for said blade means cooperating with the rearward ends of said skis to limit the rotation of said blade means into said medium to an acute angle whereat each blade member diverges forwardly with respect to the lower surface of its ski and is spaced from the rearward end of such ski so that as said actuator means rotate said blade means to engage said spacing means with the rearward ends of said skis, said blade members will plow said medium upwardly behind the rearward ends of said skis, and means operable by hand movements of the skier for energizing said actuator means to position said blade means in upward-plowing engagement with said skiing medium.

7. The apparatus of claim 6 wherein said means operable by hand movements energizes both of said actuator means at substantially the same time.

8. The method of decelerating skis individually attached to the feet of a skier and traveling on a skiing medium, each ski supporting a movable blade and a hydraulic actuator mounted to said ski and operatively connected to said movable blade, said method comprising the steps of hydraulically operating said actuators to place said movable blades in plowing engagement with said medium, and hydraulically transmitting from any blade encountering a greater reaction force than the other by reason of plowing engagement with said medium a portion of said greater reaction force to the hydraulic fluid associated with the actuator for the other blade so that said blades seek to share the work load involved in decelerating said skis by plowing said medium.

* * * * *